US006202549B1

(12) United States Patent
Mitsam et al.

(10) Patent No.: US 6,202,549 B1
(45) **Date of Patent: *Mar. 20, 2001**

(54) PROCESS AND APPARATUS FOR TRANSFERRING PRINTS FROM A SUPPORT ON TO A SUBSTRATE

(75) Inventors: Reinwald Mitsam, Langenzenn; Albrecht Germann, Würzburg, both of (DE)

(73) Assignees: Leonhard Kurz GmbH & Co., Furth; Koenig & Bauer-Albert AG, Wurzburg, both of (DE)

( * ) Notice: Subject to any disclaimer, the term of this patent is extended or adjusted under 35 U.S.C. 154(b) by 0 days.

This patent is subject to a terminal disclaimer.

(21) Appl. No.: 08/428,219

(22) PCT Filed: Jun. 23, 1993

(86) PCT No.: PCT/DE93/00555

§ 371 Date: May 12, 1995

§ 102(e) Date: May 12, 1995

(87) PCT Pub. No.: WO94/13487

PCT Pub. Date: Jun. 23, 1994

(30) Foreign Application Priority Data

Dec. 14, 1992 (DE) ..... 42 42 105

(51) Int. Cl.[7] ..... B41F 1/06

(52) U.S. Cl. ..... 101/27; 101/33

(58) Field of Search ..... 101/21, 27, 33, 101/44, 102, 107, 281, 288, 332, 336

(56) References Cited

U.S. PATENT DOCUMENTS 4,387,641 * 6/1983 Kortick ..... 101/27
4,747,345 * 5/1988 Josias et al. ..... 101/27
5,134,931 * 8/1992 Thompson et al. ..... 101/27

* cited by examiner

*Primary Examiner*—Ren Yan
(74) *Attorney, Agent, or Firm*—Hoffmann & Baron, LLP

(57) ABSTRACT

Described are a process and an apparatus for transferring prints (18, 20) from a support (16) on to a substrate (10), wherein the support (16) is transported together with the substrate (10) through a station in which the substrate (10) having print portions (12) in succession in the direction of transportation movement is provided with the prints (18, 20) in accurate register relationship. This procedure uses on the one hand a substrate (10) having at least two rows of print portions (112) side-by-side transversely to the direction of transportation movement and on the other hand a support (16) which in the direction of transportation movement has between the prints (18) for print portions (12) disposed in a row one after the other in the direction of transportation movement at least one respective additional print (20). According to the invention there are provided means, by means of which only certain prints (18, 20) can be respectively transferred selectively fron the support (16) on to the substrate (10) in the station. After leaving the station the support (16) is released frmm the substrate (10) and according to the number of additional prints (18) provided between two prints (18) for print portions (12) occurring in succession in the direction of transportation movement, fed at least one further time to the station, in which case the support (16) is displaced laterally by the transverse spacing between the adjacent rows of print portions and in the direction of transportation movement approximately by the spacing between directly successive prints (18, 20).

14 Claims, 5 Drawing Sheets

PROCESS AND APPARATUS FOR TRANSFERRING PRINTS FROM A SUPPORT ON TO A SUBSTRATE

BACKGROUND OF THE INVENTION

1. Field of the Invention

This invention relates to a process and apparatus for transferring prints from a support to a substrate, and more particularly to a process and apparatus for transferring prints from a support to a substrate having rows of print portions each including a defined surface portion.

2. Description of the Prior Art

A process for transferring a stamping foil print from a stamping foil on to a substrate and an apparatus for carrying out that process are known from DE 32 10 551 C2. That process and the apparatus are suitable for virtually endlessly impressing a substrate in the form of a flexible web of material, with a print, in the direction of forward feed movement of the substrate. The substrate may be for example a magnetic strip on a ticket or a decorative endless strip which covers a corresponding print portion, that is to say a ticket or the like, in the direction of transportation movement of the substrate from one edge of the corresponding print portion as far as the oppositely disposed edge therof.

If that known process or the apparatus provided for carrying it into effect are to be used to impress individual prints on to a substrate having print portions in succession in accurate register relationship, the distance between adjacent prints in the direction of transportation of the hot stamping foil precisely corresponds to the spacing of the print portions in the direction of transportation movement of the substrate, which is parallel to the direction of transportation movement of the hot stamfping foil. Due to that spacing between the stamping foil prints, there is between them a not inconsiderable unused empty space, that is to say stamping foil waste, and that has an effect on the economy of that known process and the apparatus provided for carrying it into effect when stamping individual images.

OBJECT OF THE PRESENT INVENTION

The object of the present invention is to provide a process and an apparatus of the kind set forth in the opening part of this specification, in which respect it is economically possible to provide a substrate having print portions in succession with individual spaced-apart prints in accurate register relationship, with the wastage of support material being relatively slight.

SUMMARY OF THE PRESENT INVENTION

By virtue of the procedure according to the invention, it is possible, in a rotatable and thus continuous mode, to provide a virtually endless substrate with at least two rows of print portions in accurate register relationship with corresponding individual prints, that is to say which represent individual images, wherein the support provided with the prints is well utilised because provided on the support, between the prints for the print portions of one row thereof, are further prints for at least one further row of print portions. In accordance with the invention therefore the wastage is relatively slight. A further advantage over discontinuously or oscillatingly operating processes for applying individual image prints to the corresponding print portions of substrates lies in the comparatively high level of productivity. Known oscillating stamping processes for stamping substrates in the form of sheets with multiple print portions achieve for example outputs of about 4000 through 6000 sheets per hour. In comparison thereto, in a rotary stamping process in accordance with above-mentioned DE 32 10 551 C2, it is possible to achieve feed speeds of the order of magnitude of 130 through 200 m/min, which when converted corresponds to about 12,000 through 18,000 sheets which can be stamped per hour. The process according to the invention makes use of the last-mentioned rotary process by means of a stamping foil or by means of a support which is provided in register relationship with an activatable adhesive. It is therefore possible for the support and the prints to be formed by a stamping foil. It is advantageous in relation to such a process if the support and the prints are formed by a hot stamping foil. In that case, the support can be transported a plurality of times through a station having a segmented heated stamping roller forming the means for the selective transfer of certain prints from the support on to the substrate, and at least one pressure roller which bears against the peripheral surface of the stamping roller. This process requires a segmented stamping roller in order actually to transfer only the respectively correct prints from the support on to the substrate while the prints disposed between same are transferred on to the corresponding substrate only after lateral displacement and the renewed feed of the support to the station.

Highly exact transfer of prints from a support on to a substrate, that is to say transfer in accurate register relationship, is afforded if, when carrying out the process according to the invention, use is made of a hot stamping foil in which the spacing of the stamping foil prints in the direction of transportation movement is shorter than the spacing of the stamping punch segments at the peripheral surface of the stamping roller, and if the hot stamping foil is stretched upstream of the stamping station in such a way that the spacing of the stamping foil prints of the or each row thereof corresponds to the spacing of the stamping punch segments. More specifically, in that way it is possible to provide for an accurately defined and exact association of the stamping foil prints with the associated print portions of the substrate to be stamped, even when the stamping roller is operating at high angular speeds.

It is helpful for the same purpose if, when using a segmented stamping roller, the rotary angular position of the stamping roller or the stamping punch segments thereof and a predetermined identification of the substrate or each print portion of the substrate can be adapted to each other by means of a regulating device. The last mentioned regulating device is desirably a so-called insetter regulating means. The identification on the substrate or each print portion of the substrate may involve suitable print marks which are detected by means of a print mark reading device and fed to the regulating device as regulating parameters. Possible side tolerances of the support with the prints or the hot stamping foil in relation to the substrate can be compensated by per se known measures such as guide rollers, in which respect support by air cushioning means or the like may also be desirable.

It has been found desirable if, in carrying out the last-mentioned process, the forward feed position of the stamping foil or the prints thereon is determined and adapted by means of the above-mentioned regulating device to the rotary angular position of the stamping station or the stamping punch segments thereof. That can be done by the above-mentioned print mark reading device which is connected to the regulating device in order for example suitably to influence a control drive with a superimposition transmission, with which the stamping roller and/or the forward feed rollers for the substrate or the stamping foil are driven.

If the process according to the invention uses a hot stamping foil, it is desirable for same to be cooled down after leaving the stamping station for the purposes of detachment from the corresponding stamped substrate and then to be fed at least one further time to the stamping station—displaced by the spacing of adjacent rows of print portions. The stamping speed can be suitably increased by such a cooling action, which has an advantageous effect on the productivity of the process according to the invention.

It has been found desirable if after leaving the stamping station the stamping foil, pivoted out of the plane of the foil through 90° of angle, is diverted around a pair of displacement rollers which are oriented perpendicularly to the stamping roller, in so doing being displaced transversely to the direction of transportation movement by the spacing of adjacent rows of print portions, and then, displaced transversely by a corresponding row of print portions, it is fed to the stamping station again so that at least two rows of print portions are simultaneously stamped with prints in the stamping station. In that arrangement the displacement rollers are desirably so provided that they are suitable for producing corresponding displacement movements adapted to the respective factors of substrates to be stamped and support with prints.

In the process according to the invention however the substrate can also be provided in accordance with the prints in register relationship with an activatable adhesive which forms the means for the selective transfer of certain prints on to the substrate and which is then activated before the substrate is fed to the station. In that respect, the activatable adhesive used can be an energy-activatable primer or a multi-component adhesive, the complementary component of which is applied to the substrate in register relationship in a manner corresponding to the prints. Depending on its composition the above-mentioned primer can be activated for example by ultra-violet or electron radiation or the like. The multi-camponent adhesive which is possibly used may be a two-camponent adhesive. If the means used in the process according to the invention for the selective transfer of certain prints on to the substrate is formed by an activatable adhesive of the above-described kind, that affords the further advantage that no segmented roller is required for the transfer of prints from the support on to the substrate, but it is possible to use a roller of a comparatively simple design configuration, without roller segments, because in this case suitable activation is effected specifically for example by irradiation or by virtue of the adhesive component of the multi-component adhesive, which component co-operates with the complementary component.

Desirably, for carrying out the process according to the invention, use is made of a support in which the prints are equidistantly spaced one behind the other in a row because in that case the regulation expenditure for carrying out the process is relatively slight.

In accordance with the invention, as already mentioned above, it is possible to use in the station a stamping roller whose stamping punch segments are at a spacing from each other in the peripheral direction, which is adapted to the spacing, in the direction of transportation movement, of successively disposed print portions of each row thereof.

The process according to the invention can use a substrate strip which is wound on a rol I; it is however also possible in accordance with the invention to use sheet-like substrates which are then successively fed to the stamping station. Consequently in the last mentioned case it is possible to omit the operation of cutting up the substrate web to form individual sheets after the stamping procedure, and that can possibly also have a positive effect on the level of productivity of the process.

With the apparatus according to the invention it is possible to use a supply device which has a roll for a virtually endless substrate in strip form. It is also possible however for the supply device to have a container for a stack of sheet-like substrates and a device for continuous feed without gaps of the individual substrate sheets to the station.

The said station may be a stamping station having a stamping roller which at its peripheral surface is provided with stamping punch segments which simultaneously stamp the print portions disposed in side-by-side relationship, the segments being spaced from each other in the peripheral direction of the stamping roller, wherein the spacing between adjacent stamping punch segments is adapted to the spacing, in the direction of transportation movement, of successively disposed print portions of each row thereof. Another possibility provides that a device for selectively applying an activatable adhesive to the substrate in register relationship is disposed between the station and the supply device. This applicator device may be a printing unit for applying the adhesive to the substrate. Printing units of that kind are known for example in the form of single-print units based on a flexographic printing unit. It is however also possible for the printing unit to be in the form of an intaglio, offset or screen printing unit. In the apparatus of the last-mentioned kind, the device for activation of the adhesive which is formed by a primer can have an irradiation device. By means of the irradiation device, depending on the primer used, it is possible to generate ultraviolet radiation, electron radiation or another suitable radiation in order appropriately to activate the primer.

It is advantageous if, in an embodiment of the apparatus according to the invention with a stamping roller having stamping punch segments, the prints provided on the support in the or each row thereof are at a spacing from each other which is slightly less than the spacing of the stamping punch segments at the peripheral surface of the stamping roller, and if disposed upstream of the stamping station are at least two braked forward feed rollers at which the support which is formed by a stamping foil experiences a change in direction and is stretched in relation to the stamping station in such a way that the spacing of the prints of the or each row thereof precisely corresponds to the spacing of the stamping punch segments. An apparatus of that kind makes it possible to provide for transfer of the prints from the carrier on to the substrate in accurate register relationship with ccparatively high cycle numbers, that is to say, at a relatively high level of productivity. It is useful for the same purpose if, in such an apparatus of the last-mentioned kind, there is provided a regulating device for adaptation of the rotary angular position of the stamping roller or its stamping punch segments to a predetermined identification on the substrate or each print portion thereof. The regulating device is desirably connected on its input side to at least one reading device and on its output side to a control drive for the stamping roller and/or for the forward feed rollers for the substrate and/or the stamping foil. The at least one reading device may be a commercially available print mark reader and the control drive may be a known drive which is designed with a superimposition transmission arrangement.

It is advantageous if provided between the forward feed rollers and the stamping station is at least one second reading device which is associated with the stamping foil and which is connected to said regulating device. The markings of the stamping foil can be detected by means of the second reading device and the signals corresponding to the detected markings can be fed to the regulating device in order to produce an accurate association between the support with the prints or the stamping foil and the stamping roller or the stamping punch segments thereof.

It has been found desirable if the displacement device has at least one pair of displacement rollers which are displaced relative to each other in parallel relationship in the direction of transportation movement and transversely thereto with respect to each other, wherein the transverse displacement of the displacement rollers of the or each pair thereof corresponds to the transverse spacing of adjacent rows of print portions of the substrate. Such a configuration of the displacement means makes it possible for the support with the print portions or the stamping foil to be at least once diverted in a loop-like manner and virtually free from distortion and deformation in relation to the means for transfer of the corresponding prints fram the support on to the substrate or in relation to the stamping station, and to be fed to the station at least one second time in order for at least two rows of print portions of the substrate which is transported through the stamping station to be simultaneously provided with prints or stamped upon, in accurate register relationship.

Good adaptation to the respective parameters of a substrate such as for example its dimensions is possible if at least one displacement roller of the or each pair thereof is adjustable in the direction of transportation movement and/or transversely relative to the direction of transportation movement. In particular the adjustability of the or each pair of displacement rollers transversely with respect to the direction of transportation movement of the substrate and consequently of the support provided with prints or the stamping foil makes it possible for the apparatus according to the invention to be accurately adapted to any substrates with more than one row of print portions.

In the apparatus according to the invention each stamping punch segment of the stamping roller can be provided with a heating means. The heating means may involve for example an electrical resistance heating means. Such an apparatus is used in connection with a hot stamping foil.

BRIEF DESCRIPTION OF THE DRAWINGS

Further details, features and advantages are apparent frem the following description of embodiments of the apparatus according to the invention for carrying out the process according to the invention, which are illustrated in the drawing in which.

DESCRIPTION OF THE PRESENT INVENTION

Figure 1:
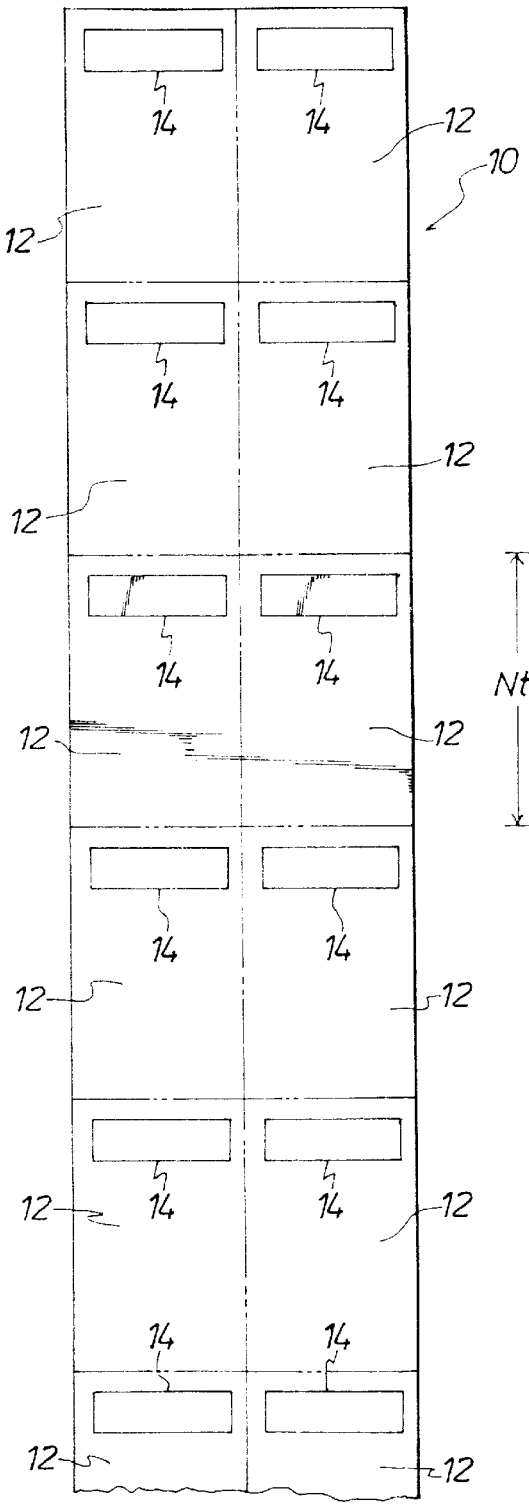
FIG. 1 is a view from above of a portion of a substrate to be provided with prints of a support in accurate register relationship.

FIG. 1 shows a portion of a flexible substrate 10 which has two rows of print portions 12 in side-by-side relationship. Each print portion 12 which can be for example a sheet of business letter paper, a banknote or the like, is to be provided at an accurately defined surface portion 14 with a print which is for example a stmping foil print. In accordance with the invention that is effected for example by means of a hot stanping foil 16 (see FIG. 2) in an apparatus as is shown in a side view and in a view frao above in FIGS. 3 and 4.

Figure 2:
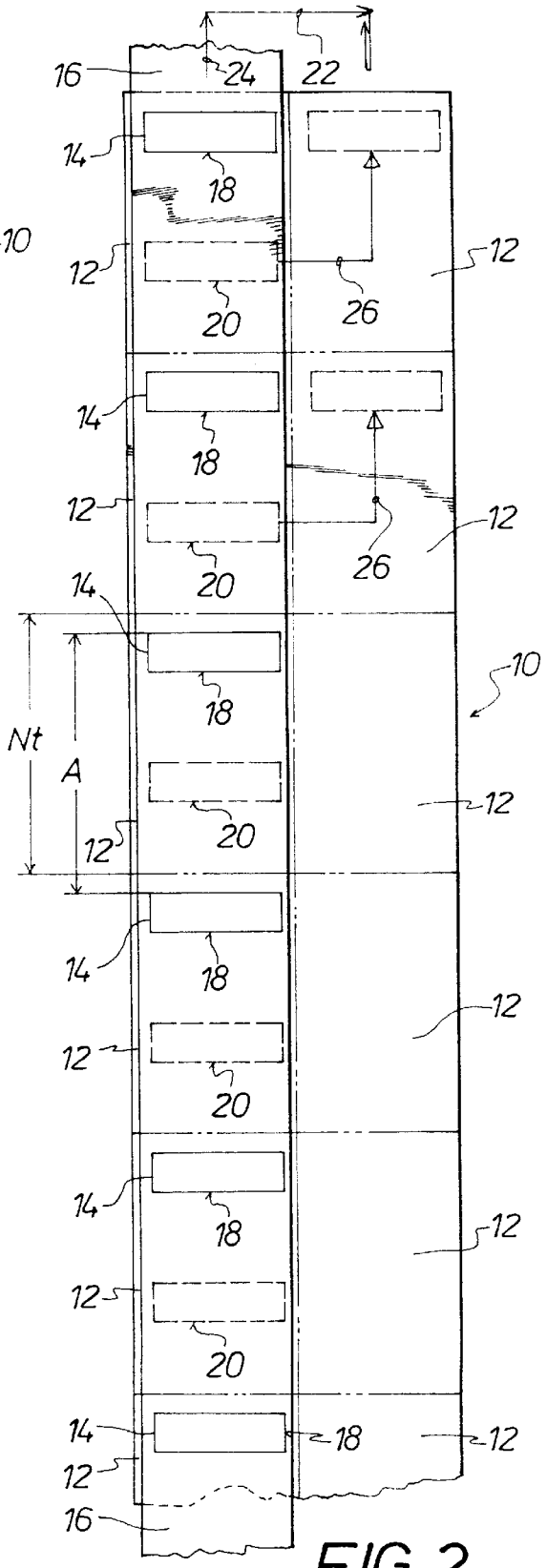
FIG. 2 is a view from above of a portion corresponding to FIG. 1 of a substrate together with a portion of a support having prints, in the form of a hot stamping foil having stamping foil prints.

FIG. 2 shows a portion of the flexible substrate 10 with two rows of print portions 12 which are disposed in side-by-side relationship. The pitch of the print portions 12 in each row is identified by Nt in FIG. 2. The surface portion 14 of each print portion 12 of a row, which is to be stamped, is at a spacing A which precisely corresponds to the print portion pitch Nt, from the surface portion 14 which is adjacent in said row of print portions 12.

The support with prints 18, of which a part is shown in FIG. 2 and which is for exmple a hot stamping foil 16, has prints 18 which in the direction of transportation movement of the stamping foil 16 are at a spacing frm each other which in the station 34 precisely corresponds to the spacing A of the surface portions 14 of adjacent print portions 12 of the corresponding row thereof and accordingly precisely corresponds in the station 34 to the print portion pitch Nt.

If the flexible substrate 10 has two rows of print portions, the staping foil 16 is provided with a respective further stamping foil print 20 between said stamping foil prints 18. If the substrate 10 has three or n rows of print portions, the stamping foil 16 is provided between the stamping foil prints 18 with two or (n-1) staping foil prints 20 respectively. All stamping foil prints 18, 20 of the stamping foil 16 are at the same spacing from each other.

After transfer of the prints 18 on to print portions 12 or their surface portions 14 of the first row of print portions, that is to say which is shown on the left-hand side in FIG. 2, the support or the starrping foil 16 is laterally displaced by the width of the print portions, downstrean of the stamping station 34, as is indicated by the arrow 22 in FIG. 2. The stamping foil 16 which is displaced in that way is again fed to the station 34 in its direction of transportation movement as indicated by the arrow 24, being displaced by the spacing of the directly adjacent stamping foil prints 18, 20, so that now the directly juxtaposed rows of print portions are simultaneously provided with the corresponding prints 18 and 20. The displacement of the prints 20 relative to the prints 18 is indicated by the arrow 26 in FIG. 2.

Figure 3:
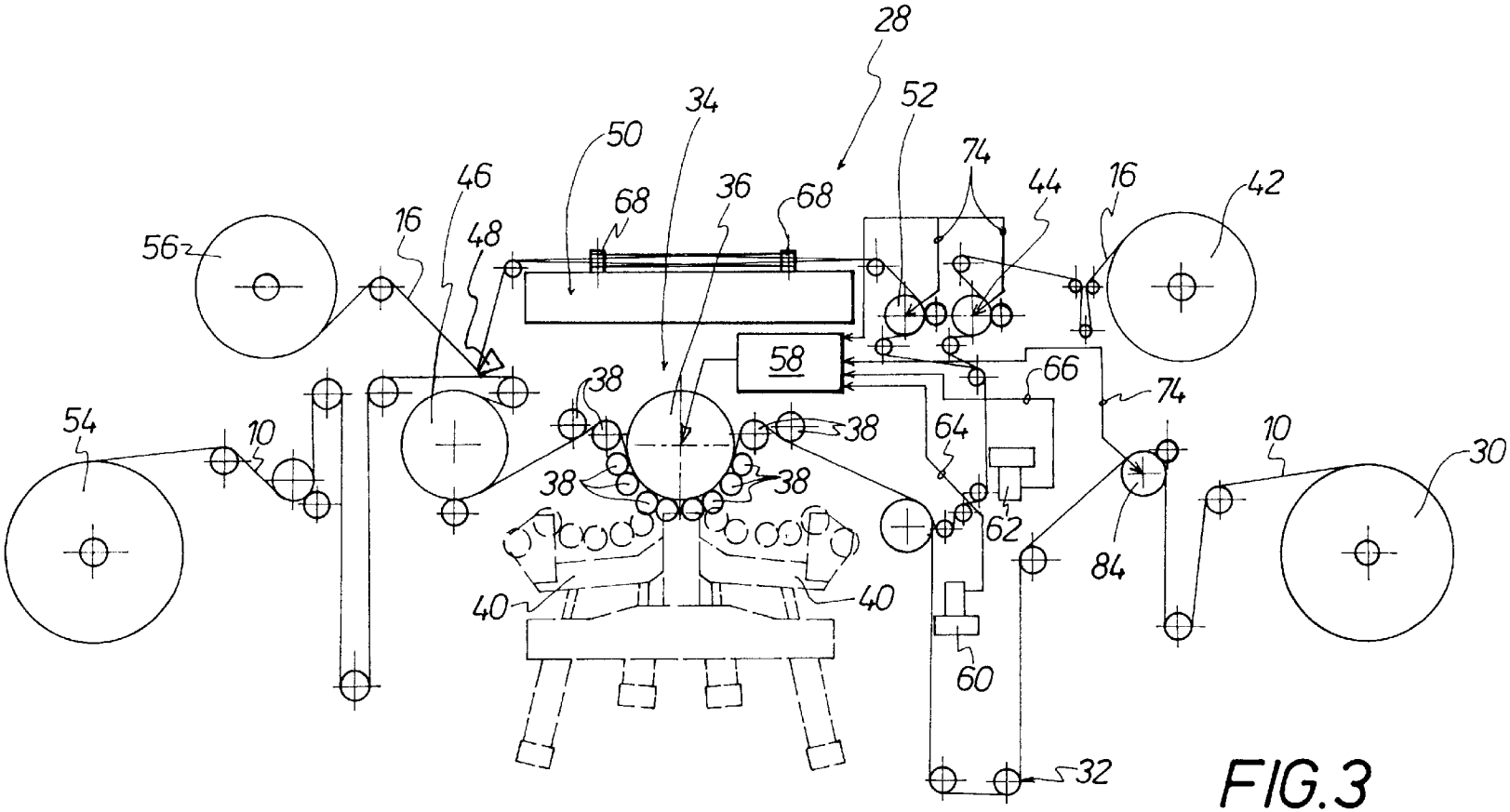
FIG. 3 is a side view of the apparatus for applying individual prints to a flexible substrate.

FIG. 3 shows an apparatus 28 for applying stamping foil prints 18, 20 (see FIG. 2) of a hot stamping foil 16 to a flexible substrate 10. The flexible substrate 10 is provided on a supply device 30 which is a supply roll. The flexible substrate 10 is in per se known manner drawn off the supply device 30 which is desirably a braked supply roller over a web regulator 32 and fed to a stamping station 34. The stamping station 34 has a stamping roller 36 and pressure rollers 38. The pressure rollers 38 are for example arranged in pairs on pivotal arms 40, the mode of operation of which has been described in above-mentioned DE 32 10 551 C2.

The hot stamping foil 16 is provided at a supply roll 42 and is fed to the stamping station 34 by way of a forward feed roller 44. In the stamping station 34 the stamping foil prints 18 corresponding to the print portions 12 of a row thereof of the flexible substrate 10 are stamped out on to the corresponding print portions 12 of said row of print portions. The stamping foil 16 is then diverted together with the flexible substrate 10 around a cooling roller 46 and fed to a detachment device 48 in which the hot stamping foil 16 is separated fram the corresponding portion of the substrate 10. Downstrean of the detachment device 48 the hot stamping foil 16 is fed by way of a displacement means 50 and a second forward feed roller 52 to the stamping station 34 again, in which case the stamping foil 16 is displaced in the displacement means 50 in its transverse direction by a row of print portions and in its forward feed direction by the spacing between directly adjacent stamping foil prints 18 and 20 so that now two adjacent rows of print portions of the flexible substrate 10 can be simultaneously stamped in the stamping station 14 in accurate register relationship, with the corresponding stamping foil prints 18, 20. After all stamping foil prints 18, 20 have been stamped out the flexible substrate 10, downstream of the detachment device 48, is fed to a take-up means 54 which is for example a winding-on roll. At the same time the used stamping foil 16 is also wound on to a winding-on roll 56.

The heated stamping roller 36 of the stamping station 34 is provided with a regulating device 58 which is diagrammatically indicated by a block in FIG. 3. The regulating device 58 is connected on the input side to a reading device 60 associated with the substrate 10 and to second reading devices 62 which are associated with the hot stamping foil 16, as is indicated in FIG. 3 by the arrows 64 and 66. Only one of those reading devices 62 can be seen in the drawing. A specific reading device 62 is provided for each passage of the foil through the apparatus. On the output side the regulating device 58 is connected to a control drive for the stamping roller 36 and/or for the forward feed rollers 44, 52 and 84 respectively.

Figure 4:
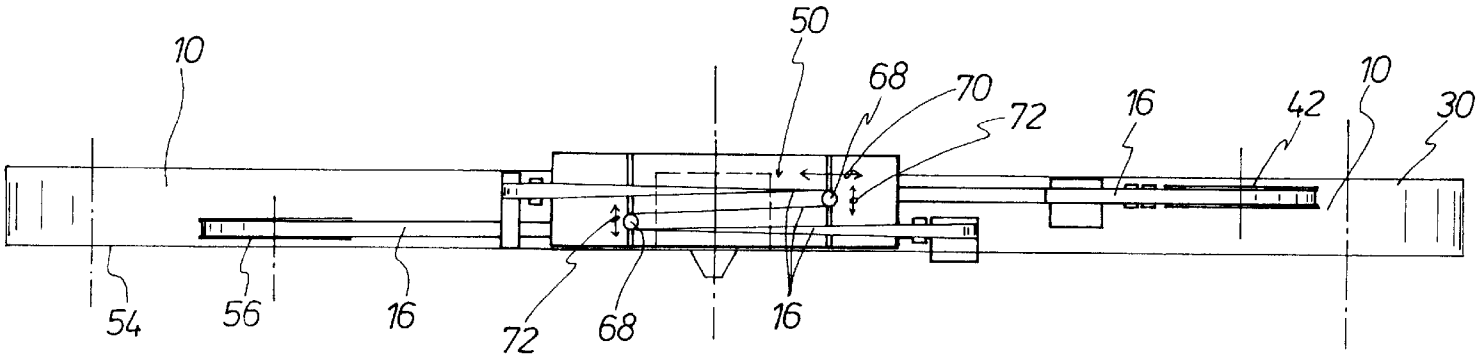
FIG. 4 is a view from above of the apparatus shown in FIG. 3, illustrating only the most Important detail features in particular for clearly showing the displacement means.

The displacement means 50 which is arranged after the stamping station 34 or in juxtaposed relationship with the stamping station 34 has at least one pair of displacement rollers 68 which are oriented parallel to each other and perpendicularly to the axis of the stamping roller 36. The displacement rollers 68 are displaced relative to each other in the direction of transportation movement of the hot stamping foil 16, as can be seen from FIGS. 3 and 4. It can also be seen from FIG. 4 that the displacement rollers 68 of the or each pair of displacement rollers are also displaced in the transverse direction, that is to say in the axial direction of the stamping roller 36, said transverse displacement of the displacement rollers 68 corresponding to the transverse spacing of adjacent rows of print portions of the substrate 10. At least one displacement roller 68 of the pair of rollers can be adjustable in the direction of transportation movement, as is indicated by the arrow 70 in FIG. 4. At least one displacement roller 68 is desirably adjustable transversely to the direction of transportation movement, as is indicated by the arrow 72 in FIG. 4. FIG. 4 also shows the supply roll 42 for the hot stamping foil 16 and the winding-on roll 56. Likewise FIG. 4 shows the supply device 30 and the take-up means 54 for the flexible substrate 10.

The forward feed rollers 44 and 52 for the hot stamping foil 16 which is fed directly to the stamping station 34 and for that which is fed to the stamping station 34 by way of the displacement means 50 are in the form of braked feed rollers and are operatively connected to the regulating device 58, as is indicated by the arrows 74 in FIG. 3. By means of the braked feed rollers 44 and 52, the hot stamping foil 16 is stretched in a defined manner in relation to the stamping station 34 so that the spacing of the stamping foil prints 18, 20 which is originally smaller than the print portion pitch Nt (see FIG. 2) is precisely equalised.

Figure 5:
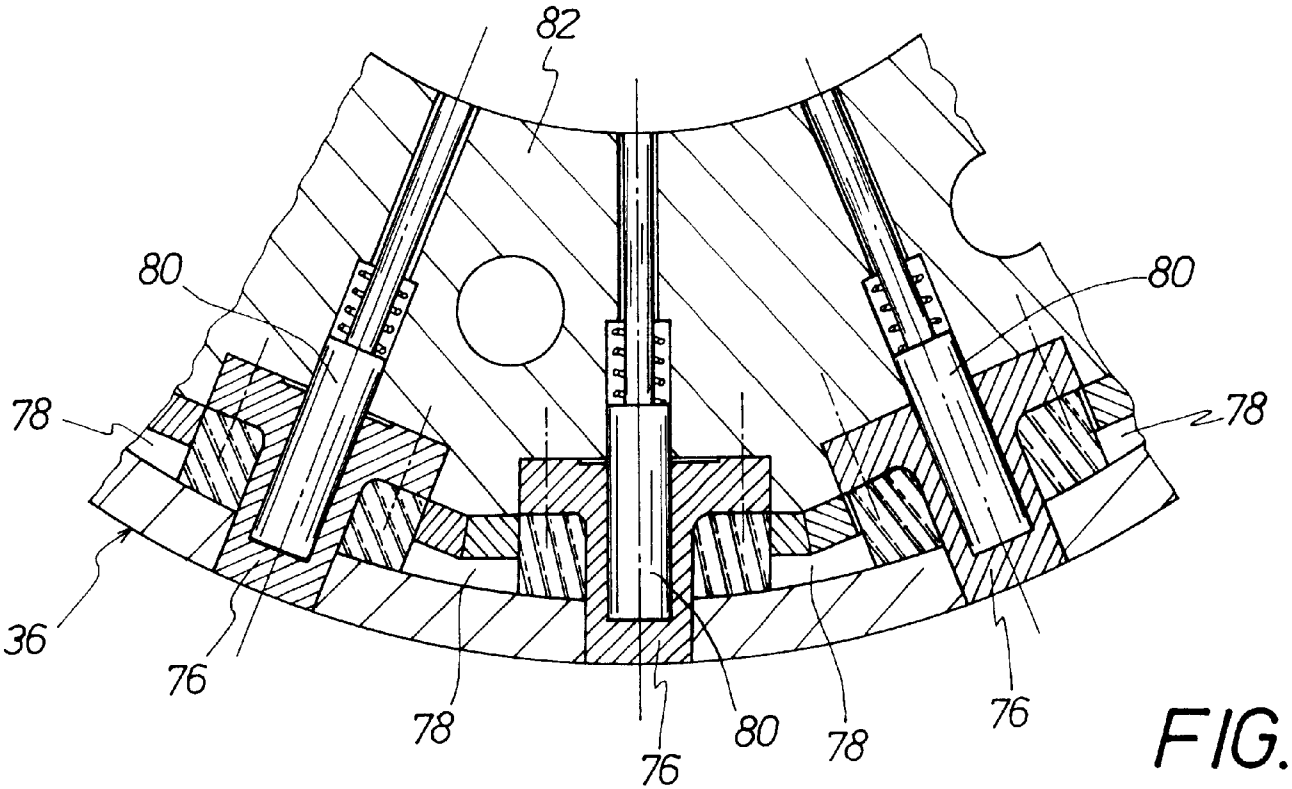
FIG. 5 is a view in section through an illustrated portion of a segmented stamping roller as is used in the apparatus shown in FIGS. 3 and 4.

As can be seen fran FIG. 5, the stamping roller 36 which is of a length corresponding to the width of the substrate is provided with stamping punch segments 76 which are equidistantly spaced frart each other in the peripheral direction of the stamping roller 36. The spacing between adjacent stamping punch segments 76 precisely corresponds to the print portion pitch Nt of the print portions 12, which are disposed in a row one behind the other, of the flexible substrate 10 (see FIG. 2). The individual stamping punch segments 76 are thermally insulated from each other. Each stamping punch segment 76 is desirably provided with a heating means 80 which may be for example per se known heating cartridge members. The stamping punch segments 76 with their heating means 80 and the cooling passages 78 are arranged on a central body 82 interchangeably and consequently in repair-friendly fashion.

Figure 6:
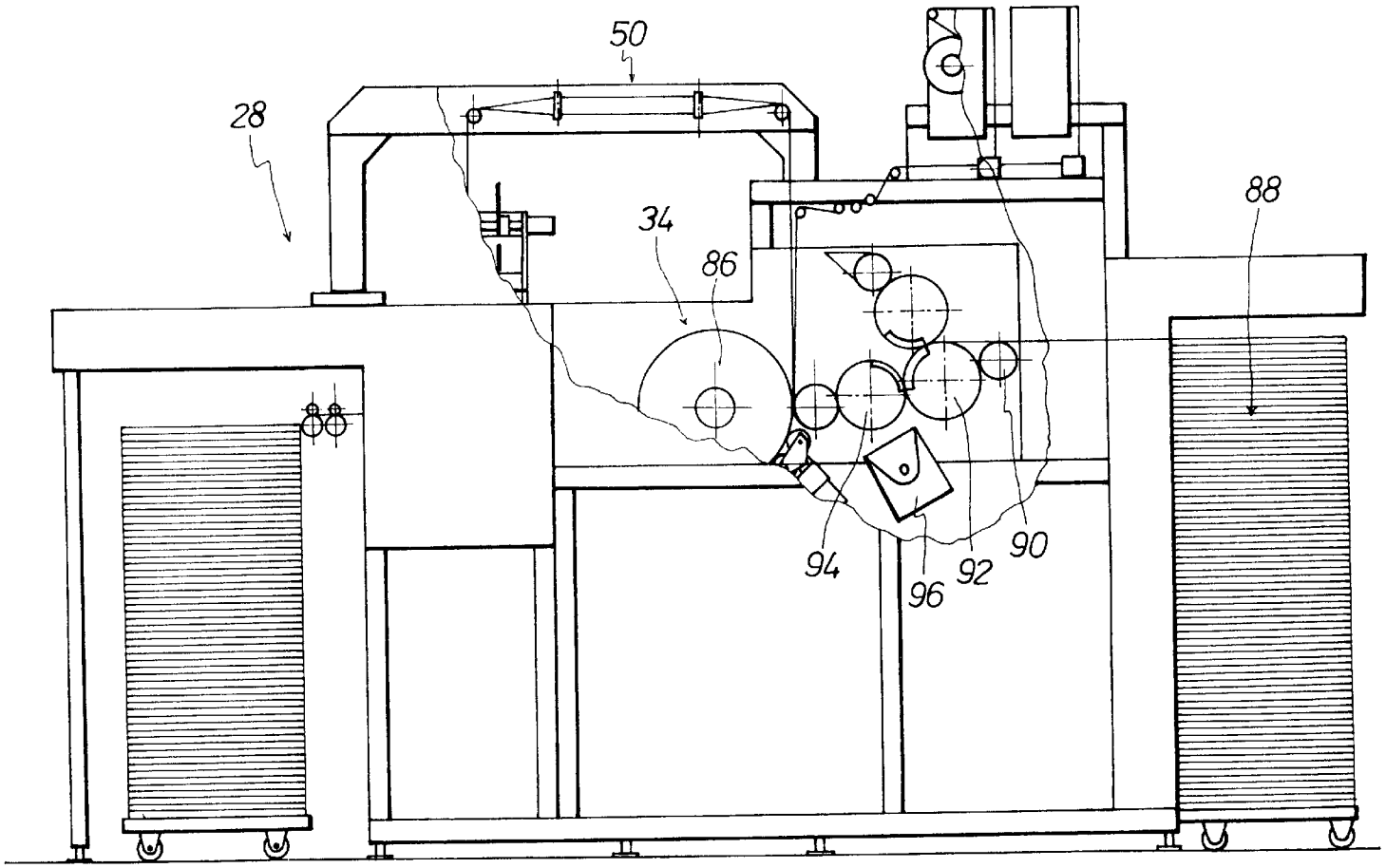
FIG. 6 is a view similar to FIG. 3 of a second embodiment of the apparatus for transferring prints from a support on to a substrate.

A stamping roller 36 of such a configuration involves a certain tructural expenditure. The stacion 36 is of a simpler design onfiguration if—as can be seen from FIG. 6—a roller 86 which is in the form of a simple roller without segments is used in the station 34. Part of the apparatus 28 is shown in cut-open form in FIG. 6 in order in particular to clearly illustrate the details with which this apparatus 28 differs from the apparatus 28 diagrammatically shown in FIG. 3. The apparatus 28 shown in FIG. 6 is a so-called sheet-fed machine, the substrates which in this case are for example paper which is cut into sheet form being fed by a feeder 88 by means of a sheet accelerating device 90 to a printing cylinder 92 which runs at machine speed. There, by means of a single-print mechanism, for example based on a flexographic print mechanism, an energy-activated primer or the complementary component of a multi-component adhesive is applied by printing to the substrates in sheet form, in correct register relationship. The substrates when prepared in that way are then transferred to a transfer drum 94 on which the primer which for example can be activated by radiation is activated by means of a radiation device 96. The radiation device 96 is for example an ultra-violet radiation source. Downstream of the transfer drum 94 the sheet substrates are introduced into the station 34. Reference numeral 50 in this Figure also identifies the displacement means, reference being made to the construction shown in FIG. 3 in regard to the displacement means 50 and the other structural members of the apparatus 28.

The invention can be used in the same manner if the prints on the support are individual prints or if regions of an individual print or print portions are to be transferred from a large-area coating on the support.

What is claimed is:

1. An apparatus for transferring a print from a support onto a substate having at least two spaced-apart rows of print portions each including a defined surface portion, which comprises:

a supply assembly for said support;

a detachment assembly means for selectably transferring, a print from said support to said defined surface portin of said print portions of a first row of said substrate and for selectively subsequently transferring a print from said support to said defined surface portion of said print portions of a second row of said print portions on said substrate; and a displacement assembly means for lateral and longitudinal displacement of said support for subsequent passage through said detachment assembly means, lateral displacement of said support being effected by a distance corresponding to a distance between said spaced-apart rows of said print portions said substrate for said subsequent passage of said support through said detachment assembly in the transfer of a print to said defined surface portion of print portion on said second row of said print portions said substrate, said longitudinal displacement being effected by a distance between prints on said support.

2. The apparatus as defined in claim 1 wherein said supply assembly includes a roll for a strip form of said support.

3. The apparatus as defined in claim 1 wherein said supply assembly includes a container for a stack of sheets of said support and further includes a transport means for continuously transporting to said detachment assembly said sheets of said support without gaps therebetween.

4. The assembly as defined in claim 1 wherein said detachment assembly includes a stamping station having a stamping roller peripherally-provided with stamping punch segments for simultaneously stamping prints disposed in side-by-side relations, such stamping punch segments being spaced-apart in a peripheral direction of said stamping roller, spacing between adjacent stamping punch segments adapted to the spacing in a direction of transport of successively-disposed print portion on a row on said substrate.

5. The apparatus as defined in claim 1 and further including an adhesive dispensing means disposed between said supply assembly and said detachment assembly for selectively applying in registered relationship an activatable adhesive to said substrate.

6. The apparatus as defined in claim 5 wherein said adhesive dispensing means includes a printer unit.

7. The apparatus as defined in claim 6 wherein said adhesive dispensing means includes an irradiation device for activation of said adhesive formed by a primer.

8. The apparatus as defined 4 and further including at least two braked forward feed rollers for said support and disposed before said stamping station for effecting a change in direction of said support as a result of stamping and for stretching said support in relationship to said stamping station to provide precise spacing of prints corresponding to spacing between said stamping punch segments.

9. The apparatus as defined in claim 8 and further including a regulating assembly for adaptation to a predetermined identification of each print portions on said substrate between a rotary angular position of said stamping roller or said stamping punch segments.

10. The apparatus as defined in claim 9 wherein said regulating assembly is connected on an input side to a reading member and on an output side to a control drive for said stamping roller and/or said forward feed rollers.

11. The apparatus as defined in claim 9 or 10 and further including a reading device disposed between said forward feed rollers and said stamping station, said reading device associated with said support and connected to said regulating assembly.

12. The apparatus as defined in claim 1 wherein said displacement assembly means includes at least one pair of spaced-apart displacement rollers displaced a distance in, parallelled relationship in a direction of transport of said support and transversely a distance corresponding to transverse spacing between said rows of print portions.

13. The apparatus as defined in claim 12 wherein one of said displacement rollers is adjustable in said direction of transport and/or a direction transverse to said direction of transport.

14. The apparatus as defined in claim 4 wherein said stamping punch segments of said stamping roller is provided with a heating element.

* * * * *

UNITED STATES PATENT AND TRADEMARK OFFICE

CERTIFICATE OF CORRECTION

PATENT NO. : 6,202,549 B1
DATED : March 20, 2001
INVENTOR(S) : Mitsam et al.

It is certified that error appears in the above-identified patent and that said Letters Patent is hereby corrected as shown below:

Column 6,
Line 43, now reads "2, the support of the starrping foil 16 is laterally displaced"
should read -- 2, the support or the stamping foil 16 is laterally displaced --

Column 8,
Line 21, now reads "certain tructural expenditure. The stacion 36 is of a simpler"
should read -- certain structural expenditure. The station 36 is of a simpler --

Column 8,
Line 22, now reads "design onfiguration if--as can be seen from FIG. 6--a roller"
should read -- design configuration if--as can be seen from FIG. 6--a roller --

Signed and Sealed this

Twenty-second Day of January, 2002

*Attest:*

*Attesting Officer*

JAMES E. ROGAN
*Director of the United States Patent and Trademark Office*